US006220000B1

(12) United States Patent
Kammler et al.

(10) Patent No.: US 6,220,000 B1
(45) Date of Patent: Apr. 24, 2001

(54) PACKAGING DEVICE

(75) Inventors: Roman Kammler, Worms; Walter Baur, Gruendau, both of (DE)

(73) Assignee: Rovema Verpackungsmaschin GmbH, Fernwald (DE)

( * ) Notice: Subject to any disclaimer, the term of this patent is extended or adjusted under 35 U.S.C. 154(b) by 0 days.

(21) Appl. No.: 09/390,919

(22) Filed: Sep. 7, 1999

(30) Foreign Application Priority Data

Sep. 8, 1998 (DE) ..... 198 40 857

(51) Int. Cl.[7] ..... B65B 9/20; B65B 31/04
(52) U.S. Cl. ..... 53/508; 53/511; 53/551
(58) Field of Search ..... 53/433, 511, 551, 53/552, 508

(56) References Cited

U.S. PATENT DOCUMENTS

| | | | | |
|---|---|---|---|---|
| 3,040,490 | | 6/1962 | Virta . | |
| 3,482,373 | * | 12/1969 | Morris | 53/511 |
| 3,528,214 | * | 9/1970 | Calvano | 53/511 |
| 3,579,945 | * | 5/1971 | Buchner | 53/511 |
| 3,664,086 | * | 5/1972 | James et al. | 53/511 |
| 4,738,287 | | 4/1988 | Klinkel . | |
| 4,964,259 | * | 10/1990 | Ylvisaker | 53/551 |

FOREIGN PATENT DOCUMENTS

| | | | | |
|---|---|---|---|---|
| 2017401 | * | 10/1971 | (DE) | 53/552 |
| 33 25 300 | | 2/1984 | (DE) . | |
| 192 604 | | 8/1986 | (DE) . | |
| 0 192 604 | | 2/1984 | (EP) . | |
| 50-83980 | * | 1/1977 | (JP) | 53/511 |

* cited by examiner

*Primary Examiner*—John Sipos
(74) *Attorney, Agent, or Firm*—Flynn, Thiel, Boutell & Tanis, P.C.

(57) ABSTRACT

A downwardly acting air-outlet nozzle (8) is provided in a device (1) for packaging between a funnel (2) and a fill pipe (5) for the purpose of producing an air stream and to thus enable filler to fall quicker through the fill pipe (5). In order to be able to determine and regulate the pressure (P) in the lower area of the foil tube, the pressure P is determined by means of a measuring device (26) and a measured-value indicator (27). The measuring device (26) can include a hollow pipe (29), which guides the pressure (P) to a measuring device (28). Tubular bags with a specific interior pressure can be manufactured with the device (1).

9 Claims, 1 Drawing Sheet

PACKAGING DEVICE

FIELD OF THE INVENTION

The subject matter of the invention relates to a device for packaging, in particular on a vertical tubular bagging machine, comprising a vertically aligned fill pipe, a funnel for filling a filler into the vertically aligned fill pipe, a forming shoulder on the fill pipe for shaping a foil sheet into a foil tube, whereby the foil tube surrounds the fill pipe, an air-outlet nozzle on the funnel and a device for producing an air stream, which device is connected to the air-outlet nozzle through a supply line, in order to produce an air stream in the funnel and in the fill pipe, which air stream enables the filler to move quicker through the funnel and the fill pipe into the foil tube than would be the case without utilizing such an air stream.

BACKGROUND OF THE INVENTION

Such a device is known from the DE-OS 0 192 604. This device provides a plurality of flap-shaped air nozzles in the funnel wall or the fill pipe for the purpose of producing a downwardly directed air stream in the fill pipe in order to permit a filler to drop quicker than with the natural dropping speed.

A further device of this type is known from the DE-OS 33 25 300. An annular gap below the funnel is in this device used to supply an accelerating air stream.

The known devices have the disadvantage that they result in an uncontrolled expansion of the lower area of the foil tube to be filled and of the thus created tubular bags.

SUMMARY OF THE INVENTION

The basic purpose of the invention is to further develop a device of the above-described type in such a manner that tubular bags with a specific constant interior pressure can be manufactured in a reliable manner.

The purpose of the invention is attained by providing a device for packaging a filler material into bags, which device includes an air stream producing device and an air pressure measuring device. Accordingly, a measuring device for measuring the pressure existing in the lower area of the foil tube is provided, and the measuring device is connected to a measured-value indicator.

The invention has the advantage that the pressure existing in the lower area of the foil tube and thus in the tubular bag to be created is indicated. Thus, the strength of the air stream can be adjusted such that a specific pressure is reached. In the case that this interior pressure deviates, the air stream is changed in order to maintain a constant pressure value.

In the case of a different filler or a different bag size, a different interior pressure may make sense. For example, easily breakable filler parts could be packaged with a relatively high interior pressure in the tubular bag in order to protect the filler parts.

A measuring device, which can be easily realized and is reliable, is achieved when the measuring device includes an open ended pipe, the pipe is guided through the forming shoulder, and the measured-value indicator is provided outside of the foil tube. The pipe transmits the pressure existing in the lower area of the foil tube into a measuring device, which is, for example, provided outside of the foil tube, and the measured value of which is indicated by the measured-value indicator. Because of the measured-value indicator, the air stream can be adjusted manually or by means of a control unit. Due to the fact that the pipe is guided through the inside area of the forming shoulder, the manufacture of the tube is not influenced.

The measured-value transfer can occur wirelessly without any influence on the packaging device when the measuring device houses a measured-value transmitter, and a measured-value receiver is provided outside of the foil tube, which measured-value receiver is connected to the measured-value indicator.

A downwardly acting air-outlet nozzle in the opening between the funnel and the fill pipe has the advantage that common funnels and fill pipes can be utilized in order to move the air stream into the fill pipe. The air-outlet nozzle is provided where the funnel being slightly removed from the fill pipe creates a gap. The air-outlet nozzle provides an air stream in downward direction and creates a negative pressure in the funnel so that a filler passes more quickly through the funnel. An air stream directed downwardly by the air nozzle additionally accelerates the filler during its free fall.

When the air-outlet nozzle is a circular gap, which is enclosed by an annular cylindrical pressure chamber surrounding the funnel or the fill pipe, then an even air stream is created, which grabs all particles of the filler in the same manner, and which thus results in a particularly short packaging time. The pipe does not interfere with the air stream.

The air stream accelerating the filler is further improved when in addition to the air-outlet nozzle a suction device is provided. When the fill pipe is concentrically surrounded by a downwardly open format pipe, and the space between the fill pipe and the format pipe is connected to the suction device, then the air in the fill pipe can flow downwardly in order to shorten the falling time of the filler, and can escape upwardly through the space. The foil tube is hereby received by the format pipe and slides along same.

When a control unit is provided on the device for adjusting the excess pressure in a bag to be created, then the air stream can be adjusted in an advantageous manner such that a specific excess pressure is provided, for example, for a specific bag size and a specific filler. In particular in the case of a filler, for example potato chips, reacting to an air stream, such a control unit, which controls the air stream also dependent on the performance of the packaging machine, is advantageous. In addition, a bag tightly filled with air offers the filler a protection against damage. If, in addition, the control device is connected to the measured-value indicator, the control device can be dependent on the measured interior pressure to maintain the same constant pressure.

A technical simplification of the device exists when the device for producing an air stream is also provided as a suction device. Then a flow cycle for the air is essentially achieved.

The air stream is further improved by means of a further air-outlet nozzle and the falling speed can be further increased, for example, by a greater or more exact air stream. The additional air-outlet nozzle can be provided in the funnel, in the fill pipe or on the inside wall of the fill pipe.

When the funnel or the fill pipe is elevationally adjustable in such a manner that an air-outlet nozzle is selectively created, then packaging can be done with the device selectively with or without support through an air stream. The producible air-outlet nozzle is then created by a slight moving apart of funnel and fill pipe and is again eliminated by a moving toward one another of funnel and fill pipe. The size and thus the performance of the nozzle can be varied, when the funnel or the fill pipe are elevationally adjustable such that the air-outlet nozzle can be adjusted narrower or wider. The air stream or the falling behavior of the filler can in this manner be influenced by means of a simple elevation-adjusting device. The elevational adjustment can be taken into consideration when controlling the air stream.

BRIEF DESCRIPTION OF THE DRAWING

The invention will be explained in greater detail hereinafter in connection with one figure, which shows.

DETAILED DESCRIPTION

Figure 1:
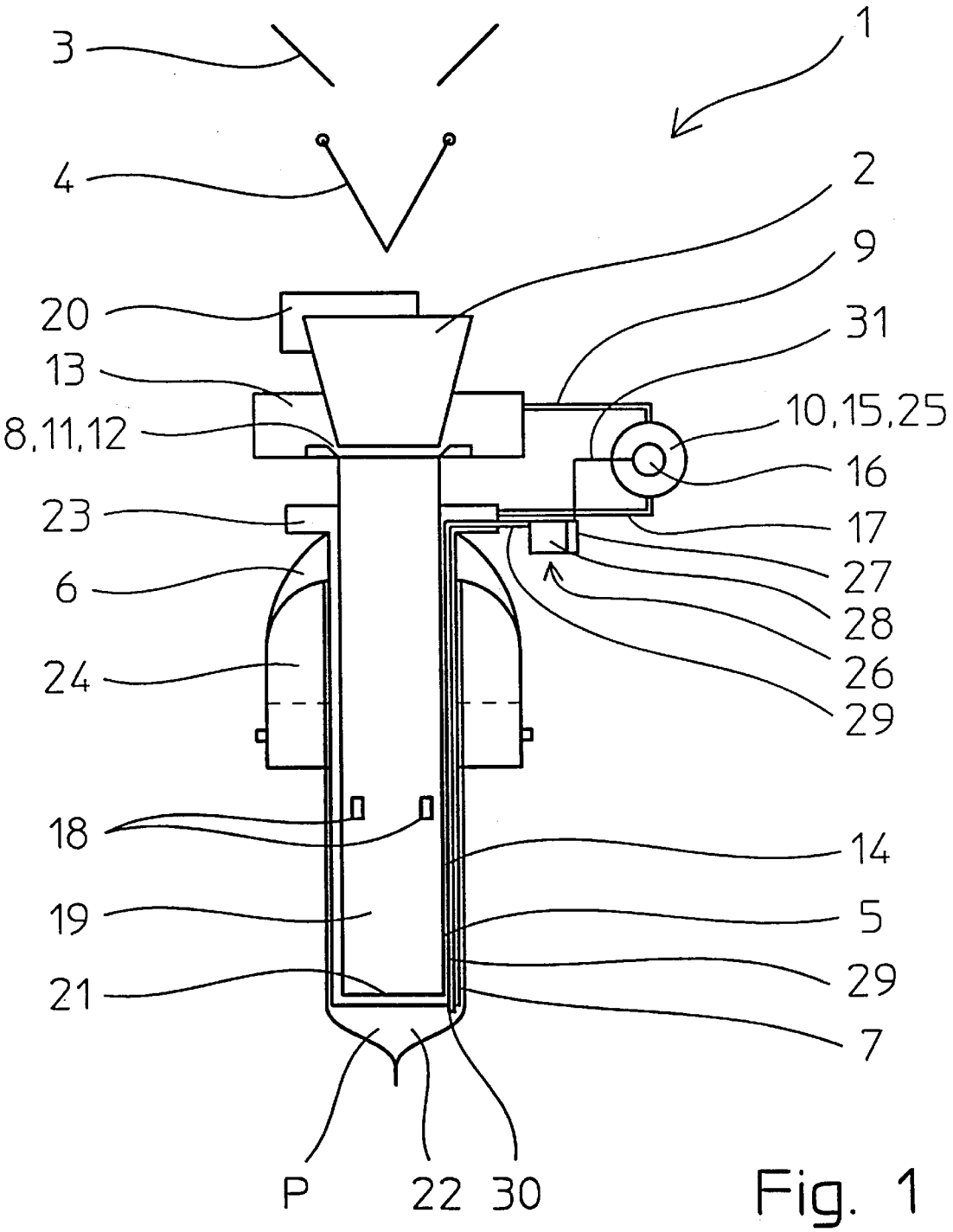
FIG. 1 s a side view with a vertical cross section of the fill pipe, a device for packaging comprising a funnel for filling a filler into a fill pipe, an air-outlet nozzle equipped with a circular gap between the funnel and the fill pipe, which is surrounded by a pressure chamber, a device for producing an air stream, which pumps air to the air-outlet nozzle and sucks in air through a space between the fill pipe and a format pipe enveloping the fill pipe, a forming shoulder for shaping a foil sheet into a foil tube, a dosing device and a timing hopper above, two additional airoutlet nozzles in the device, and a measuring device for measuring the pressure existing in the lower area of the foil tube, which measuring device includes a pipe, which is connected to a measured-value indicator arranged outside of the foil tube.

A funnel 2 is used in a device 1 for packing to fill a filler measuredly delivered by a dosing device 3 and a timing hopper 4 into a fill pipe 5. The fill pipe 5 is vertically aligned and is part of a vertical tubular bagging machine.

A forming shoulder 6 is used for shaping a flat foil sheet 24 into a foil tube 22, which is received by a format pipe 7, and into which filling is supposed to occur.

An air-outlet nozzle 8 exists on the funnel 2, which air-outlet nozzle is supplied with pressurized air through a supply line 9 from a device 10 in order to produce an air stream. The air stream is downwardly directed in the fill pipe 5 in order to move the filler quicker through the funnel 2 and the fill pipe 5 into the foil tube than occurs during a free fall.

The air-outlet nozzle 8 is provided in an opening 11 between the funnel 2 and the fill pipe 5. The air-outlet nozzle 8 is a circular gap 12, to which is connected an annularly cylindrical pressure chamber 13 surrounding the funnel 2. The fill pipe 5 is concentrically surrounded by the format pipe 7, which is open at the bottom. A space 14 between the fill pipe 5 and the format pipe 7 is connected to the device 10 through a conduit 17, which device serves also as a suction device 15 for the air stream exiting from below the fill pipe 5. A specific excess pressure is achieved in the fill pipe 5 and thus in the bag to be manufactured by means of a control unit 16 on the device 10.

In addition to the air-outlet nozzle 8 two further air-outlet nozzles 18 are provided, which are supplied by a separate pressure-air producer, and which are provided on the inside wall 19 of the fill pipe 5.

The funnel 2 is elevationally adjustable by means of an elevation-adjusting device 20, for example by motors, linear actuators, etc., in such a manner that the air-outlet nozzle 8 can be adjustably made narrower or wider.

A filler portion is initially transferred from the dosing device 3 to the timing hopper 4. Same timely exactly drops the filler into the fill pipe 5. The device 10 permanently supplies pressurized air to the pressure chamber 13 so that the air-outlet nozzles 8, 18 maintain a permanent air stream downwardly in the fill pipe 5. However, it would also be possible to produce a pulselike air stream with the inventive device. The air stream exits at the lower end 21 of the fill pipe 5 from the fill pipe 5. The filler moved downwardly accelerated by the air stream is there delivered into the foil tube 22 welded shut at the bottom. The air stream,on the other hand, travels through the space 14, the cover 23 and the conduit 17 to the device 10, which is a blower 25.

In order to be able to determine and, if necessary, readjust the pressure inside of the foil tube 22 and thus inside of the tubular bag to be produced, a measuring device 26 is provided for measuring the pressure P existing in the lower area of the foil tube 22. The measuring device 26 is connected to a measured-value indicator 27.

The measuring device 26 consists of an air-pressure measuring device 28 and a hollow pipe 29 connected to the air-pressure measuring device 28. The open end 30 of the pipe 29 projects into the lower area of the foil tube 22 and transfers the pressure existing therein to the air-pressure measuring device 28. The pipe 29 moves through the forming shoulder 6 out of the foil tube 22.

The measured-value indicator 27, which first produces a usable measured-value signal, is connected to the control unit 16 through the line 31. The device 10 can thus be operated dependent on the desired pressure P.

Although a particular preferred embodiment of the invention is disclosed in detail for illustrative purposes, it is recognized that variations or modifications of the disclosed apparatus, including the rearrangement of parts, lie within the scope of the present invention.

What is claimed is:

1. A device for packaging including a vertically aligned fill pipe, a funnel for feeding a fill material into the fill pipe, a forming shoulder for shaping a foil sheet into a foil tube to be filled, whereby the foil tube surrounds the fill pipe, an air-outlet nozzle defined in a space between the funnel and the fill pipe, and a mechanism connected to the air-outlet nozzle through a supply pipeline for producing a variable pressure air flow in order to create a downward air flow in the funnel and in the fill pipe, which air flow entrains the fill material to enable quick movement thereof through the funnel and the fill pipe into the foil tube, a format pipe surrounding said fill pipe, the air flow and entrained fill material moving downwardly throughout the length of said fill pipe, means for removing the air flow from the foil tube and the lower end of said fill pipe, and a measuring device for measuring an air flow pressure produced by said mechanism, said measuring device including an air flow pressure monitoring opening oriented at the lower end of the fill pipe and inside of the foil tube and a measured value indicator responsive to the pressure present at the pressure monitoring opening for controlling the air flow pressure at the lower end of the fill pipe and inside of the foil tube.

2. The device according to claim 1, wherein the measuring device includes a pipe connected thereto and having an open end at one end thereof remote from the measuring device to thereby define the pressure monitoring opening, the pipe being guided through the forming shoulder between the fill pipe and the format pipe so that the open end is oriented at the lower end of the fill pipe and inside of the foil tube, and the measured-value indicator is provided outside of the foil tube.

3. The device according to claim 1, wherein the air-outlet nozzle is a circular gap, to which is connected an annular pressure chamber surrounding the funnel or the fill pipe.

4. The device according to claim 1, wherein the measured value indicator includes a control unit for controlling the mechanism to adjust the pressure produced thereby inside a bag to be created.

5. The device according to claim 1, wherein the mechanism is a suction device.

6. The device according to claim 1, wherein in addition to the air-outlet nozzle lying between the funnel and the fill pipe, at least one further air-outlet nozzle is provided.

7. The device according to claim 6, wherein the additional air-outlet nozzle is provided in at least one of the funnel and on the inside wall of the fill pipe.

8. The device according to claim 1, wherein at least one of the funnel and the fill pipe are elevationally adjusted by means of an elevation-adjusting device such that an air-outlet nozzle is selectively created.

9. The device according to claim 8, wherein the at least one of the funnel and the fill pipe is elevationally adjustable such that the air-outlet nozzle can be adjusted to be narrower or wider.

* * * * *